US006735827B1

(12) United States Patent
Stenhäll

(10) Patent No.: US 6,735,827 B1
(45) Date of Patent: May 18, 2004

(54) SLIDER FOR A ZIP FASTENER

(76) Inventor: Turo Stenhäll, Tsing Yi, N.T., Hong Kong (HK)

( * ) Notice: Subject to any disclaimer, the term of this patent is extended or adjusted under 35 U.S.C. 154(b) by 0 days.

(21) Appl. No.: 10/328,256

(22) Filed: Dec. 23, 2002

(51) Int. Cl.[7] ..... A44B 19/30
(52) U.S. Cl. ..... 24/419; 24/429
(58) Field of Search ..... 24/429–431, 419

(56) References Cited

U.S. PATENT DOCUMENTS

| | | | | | |
|---|---|---|---|---|---|
| 1,681,549 | A | | 8/1928 | Marinsky | |
| 1,681,550 | A | * | 8/1928 | Marinsky | 24/429 |
| 1,966,255 | A | * | 7/1934 | Marinsky | 24/419 |
| 2,018,948 | A | * | 10/1935 | Corner | 24/424 |
| 2,325,709 | A | * | 8/1943 | Samstegman | 24/426 |
| 3,075,269 | A | * | 1/1963 | Simberg | 24/419 |
| 3,419,943 | A | | 1/1969 | Heimberger | 24/205.14 |
| 3,602,958 | A | | 9/1971 | Glindmeyer | 24/205.14 |
| 3,820,203 | A | * | 6/1974 | Takamatsu | 24/419 |
| 4,570,309 | A | | 2/1986 | Ishii | 24/429 |
| 4,780,938 | A | * | 11/1988 | Ishii | 24/429 |
| 5,083,349 | A | * | 1/1992 | Axtell | 24/429 |

FOREIGN PATENT DOCUMENTS

| | | | | |
|---|---|---|---|---|
| EP | 1095584 | | 5/2001 | |
| EP | 1295542 | A2 * | 3/2003 | A44B/19/26 |
| GB | 357930 | | 10/1931 | |
| GB | 402416 | | 11/1933 | |
| GB | 769468 | | 3/1957 | |
| GB | 828240 | | 2/1960 | |
| WO | WO 9737558 | A1 * | 10/1997 | A44B/19/26 |

* cited by examiner

*Primary Examiner*—James R. Brittain
(74) *Attorney, Agent, or Firm*—Steinberg & Raskin, P.C.

(57) ABSTRACT

The invention relates to a slider for a zip fastener including a pull tab (15) and a slider body (20) having a top plate (21) and a bottom plate (23) and a wedge-shaped part (22) connecting them as well as a tab holder (25) for attachment of a loop of the pull tab (15) of the zip fastener slider or a loop thereof made into a shape of a clamp part. A tail part (26) of the tab holder (25) of the zip fastener slider (20) extends outside the slider body (20) and a throat (24) such that between the tail part (26) of the tab holder (25) and the end of the top plate (21) of the slider body (20) there remains a threading gap/threading point (28) through which the pull tab (15) can be threaded into connection with the tab holder (25).

20 Claims, 17 Drawing Sheets

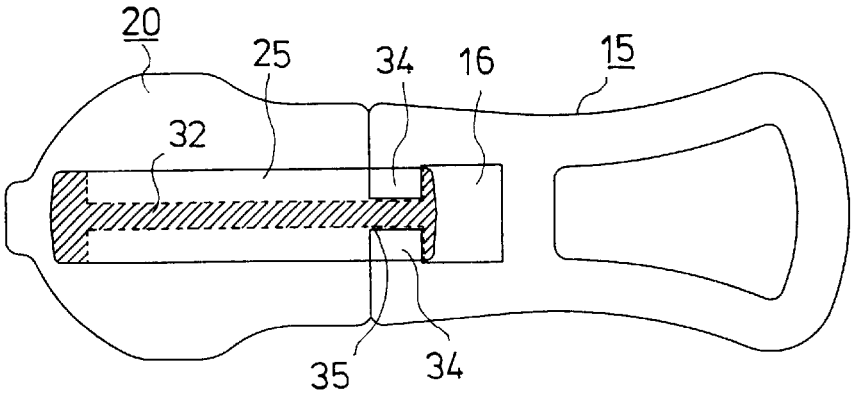
FIG. 12B
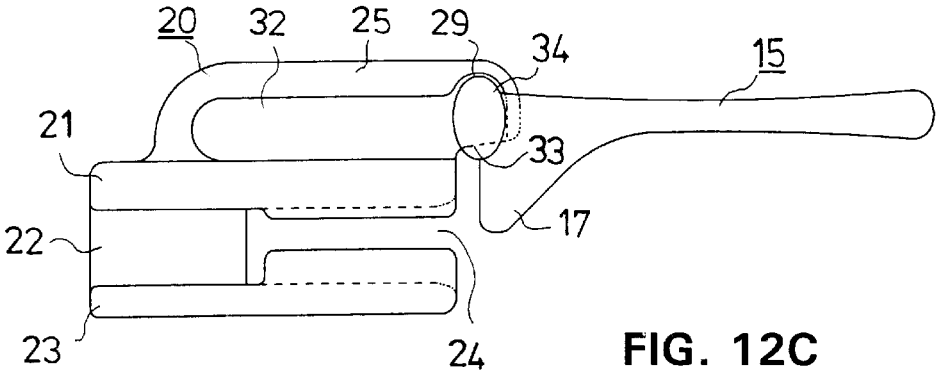
FIG. 12C
FIG. 12D
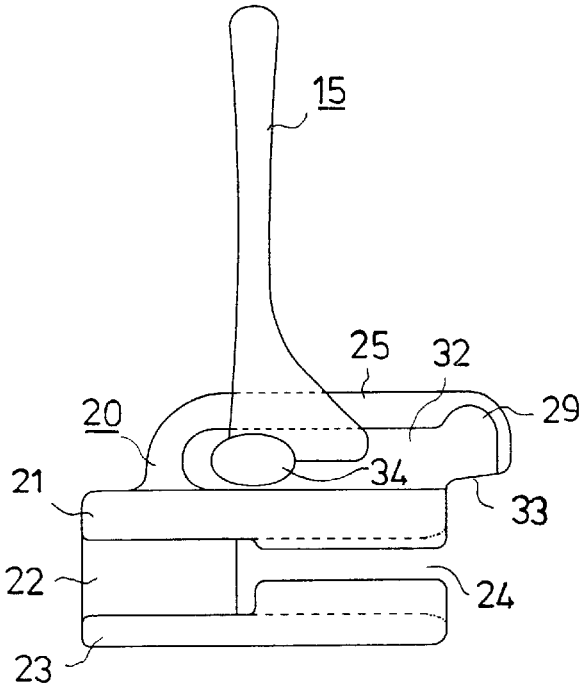

SLIDER FOR A ZIP FASTENER

FIELD OF THE INVENTION

The present invention relates to a slider for a zip fastener.

BACKGROUND OF THE INVENTION

As known in prior art, the slider of the zip fastener is a part which is formed by a slider body and a pull tab and which moves on the zip fastener. The slider opens the zip fastener by separating opposite rows of teeth from each other and, in a corresponding manner, closes the zip fastener by engaging the rows of teeth with each other. The slider of the zip fastener generally comprises 2 to 5 components. Since the slider of the zip fastener is formed of small, separate components, it always involves a separate assembly operation, which is complicated and time-consuming and thus it also increases manufacturing costs.

In prior art there are known many types of zip fastener sliders which are conventionally divided into the groups: retainer sliders, which include automatic lock sliders and pin lock sliders, and non-retainer sliders. Different zip fastener types are described, for example. in the SFS Standard 4330 "Slide fasteners. Terminology and definitions".

In the applications known in prior art, for example, the tab holder part of the slider on the zip fastener must be bent to bring the pull tab of the zip fastener into its position because, in the assembly stage of the zip fastener, the tab holder of the body is open and the pull tab is threaded into its position and after that the tab holder is pressed to its proper position. In automatic lock sliders and pin lock sliders, many different arrangements are known in which the locking operation is provided by means of small spring parts and the like.

Finding a separate slot in the zip fastener itself for the tip of a locking pin or a locking spring in the zip fastener itself is usually a problem in the prior art sliders provided with a retainer.

OBJECTS AND SUMMARY OF THE INVENTION

An object of the invention is to provide a zip fastener slider which is simple in structure and in its mode of assembly yet offers numerous possibilities of producing different lock types.

An object of the invention is to provide a zip fastener slider having a pull tab which remains in connection with the slider when the zip fastener is in place in the slider of the zip fastener.

It is also an object of the invention to provide a zip fastener slider whose tab holder need not be bent for disposing a pull tab in place in connection with manufacture.

It is also a further object of the invention to provide a zip fastener slider which is provided with a retainer and in which locking operates without a slot intended for the tip of a locking pin or a locking spring in the zip fastener.

An important object of the invention is also to provide a zip fastener slider in which a spring effect is produced without a spring. In prior art there is known a "pin lock" whose pin tip is rounded, but in that connection a tooth made of metal or another material is pressed against the zip fastener without a spring effect, with the result that the operation of locking is forced. In these known applications, finding a slot in the zip fastener for the locking tip is problematic because it is difficult to find it and it may break the zip fastener.

What is new and inventive in the zip fastener slider in accordance with the invention is particularly that the pull tab is threaded into its position through a threading gap/threading point between the tail of a tab holder/the tail of a rail part and the body of the slider outside the body of the slider and the throat of the slider. The zip fastener slider in accordance with the invention provides numerous locking alternatives for the zip fastener slider, the flexibility of which alternatives is easily and reliably adjustable, by placing the threading point/threading gap, a retainer head, a snap point and/or textile material in the ways in accordance with the different embodiments of the invention. The flexibility of the zip fastener slider in accordance with the invention and its applicability to different types of locking alternatives can thus be adjusted and accomplished without separate spring parts and the like and without a hole intended for a locking pin in the cover plate (upper cover) of the slider.

It is the wide range of locking in particular that is new and inventive in the zip fastener slider in accordance with the invention. By means of the zip fastener slider in accordance with the invention, locking can be provided by pressing a locking head into some suitable slot or against a locking surface, which can be the surface of a tooth or the surface of the entire tooth system or the surface of a textile tape, the surface of the textile tape outside the tooth system or the sides of the tooth system may even be used.

In accordance with the invention, a spring effect without a spring is produced by means of a snap slot located under a tab holder or a rail or by means of another equivalent recess. The spring effect can also be produced by means of a retainer head. The retainer head can be made of a hard or flexible material or it can be shaped to be flexible.

When the pressing stage of the retainer head takes place outside the throat of the slider, a smaller or greater spring effect is produced in which the tab holder can behave flexibly, in which the retainer head can behave flexibly and in which the zip fastener 10 behaves flexibly, which flexible behaviours and the dimensioning of lever arms serve to provide a locking head that is positioned beyond the dead centre. This kind of locking can be absolutely tight, while, for example, the prior art locking accomplished by a spring is hardly ever so tight; or it can be even very light locking according to the need of dimensioning in each particular case.

It is not necessary to use more than one of the above-mentioned flexible elements at a time.

In accordance with the invention, a spring effect is produced without a spring by shaping the members of the slider of the zip fastener in a suitable manner. In accordance with the invention, for example, under the tab holder there is a snap slot or the tab holder or the retainer head of the pull tab is shaped to be flexible or the retainer head is made of a flexible material. It is also possible to produce the spring effect such that the zip fastener is made flexible within the throat of the zip fastener slider, for example, by making a hole in the lower cover of the zip fastener slider, thereby producing a spring effect without a spring made of a steel or other material. Thus, in accordance with the invention, compression locking is achieved in a simple manner and which does not cause any problems in finding a locking location for the zip fastener and does not damage the zip fastener. The spring effect in accordance with the invention is also operative inside the top plate and the throat of the zip fastener slider.

In accordance with one embodiment of the invention, a slider for a zip fastener is provided in which locking operates outside the cover plate without an opening (hole) in the cover plate.

Further, in accordance with one embodiment of the invention, a slider for a zip fastener is provided in which locking operates by pressing the zip fastener outside or from outside the rear of the slider throat and in which said pressing force and location can be adjusted by dimensioning, shaping, and selection of materials of the parts, without a spring usually needed in the sliders of zip fasteners.

In accordance with one embodiment of the invention, a slider for a zip fastener is provided in which the location of pressing may be any part of the zip fastener. The location may be teeth of the zip fastener, a gap in the teeth, or pressing may be directed at edges of the teeth or at both the teeth and the textile tapes of the zip fastener or even at the textile tapes of the zip fastener alone.

The zip fastener slider in accordance with the invention is simple in construction and in its mode of assembly, and it is substantially formed of two parts: a slider body and a pull tab. A tab holder part formed in connection with the slider body enables the pull tab to be fastened in place. The tab holder part may be formed such that below it and between the top plate of the slider body there remains a space in which the loop portion of the pull tab is located when the loop of the pull tab has been threaded into place around the tab holder part of the slider body. The tab holder part may also be formed so that it is rail-shaped, in which case it comprises a tab-holder-like enlarged portion and a narrower rail portion which is attached to the top plate of the slider body. In that connection, the loop of the pull tab is formed to be clamp-like and the clamp parts are pressed to the rail part on both sides of it and the loop portion is substantially around the enlarged portion. A threading gap/threading point for the pull tab is formed in connection with the tab holder part in the slider body of the zip fastener such that the pull tab cannot fall off when the zip fastener is in place in the slider body. The threading gap/threading point is placed substantially outside the top plate, advantageously at the rear of the slider with respect to the running direction of the slider closing the zip fastener, i.e. viewed in the horizontal plane from outside the rear of the top plate.

In accordance with the invention, the pull tab is primarily prevented from coming off the slider by the placement of the zip fastener in position in the slider and, in accordance with one advantageous embodiment of the invention, the zip fastener substantially closes the threading gap of the pull tab formed between the tail part of the tab holder part of the slider and the top plate of the slider. The tab holder of the slider need not be bent at the assembly stage of the slider because the pull tab can be passed between the slider body and the tab holder into its position as the end part of the tab holder extends so that it is at a distance from the rear end of the slider body, i.e. from the rear of the slider with respect to the running direction of the slider closing the zip fastener, in which connection there remains a space between them, that is, a threading gap for threading the loop of the pull tab into place. When the slider is in place, the tail part of the tab holder extends to the substantial vicinity of the zip fastener, in which connection the pull tab is not able to fall away from its place.

In accordance with one advantageous embodiment of the invention, a rail-shaped tab holder part is formed on the body of the zip fastener slider, a threading point for the pull tab being formed in connection with said tab holder part such that the threading point extends outside the slider body such that the zip fastener situated in place in the slider body prevents the pull tab from falling away from its place but the pull tab can be easily threaded into place before the zip fastener is inserted in the slider body. The tab holder part has thus been formed into a rail, in which connection the tab holder part comprises an outer enlarged portion and which in the front part of the zip fastener extends to the slider body and in the rear part forms an edge part of a threading gap and the rail part of which is substantially narrower than the enlarged part, forming a rail on which a clamp-like pull tab is arranged to be moved and onto which portion the pull tab is passed through the threading point. In this exemplifying embodiment of the invention, the threading portion of the pull tab in the rail part has been so shaped that the pull tab is not able to fall away from its place when the zip fastener is in place in the slider body of the zip fastener. The tab holder part of the body and the pull tab have been so shaped that the threading point of the pull tab formed between the slider body and the tail part of the tab holder part extends close to the zip fastener so that the pull tab remains in connection with the slider body when the zip fastener is in place in the slider of the zip fastener.

In accordance with one advantageous further feature of the invention, in the case of zip fastener sliders provided with a retainer, the locking of the slider onto the zip fastener is most advantageously arranged so that the retainer head of the pull tab is pressed against the zip fastener, and the locking force required in the zip fastener slider, the snapping of the pull tab into a locking position and away from the locking position, can be adjusted by displacing the locking points or by shaping the lower surface of the tab holder/rail part or by making use of the stiffness or bending of the zip fastener outside the throat of the slider or by the choice, stiffness and bending of the material of the pull tab itself. The locking of the slider can be easily adjusted for different purposes and chain types by shaping, for example, the retainer head of the pull tab or other parts of the slider according to each particular need. By displacing the locking point, a fully locking version can be made into an arrangement in which the locking holds only up to a certain desired limit. In that case, the zip fastener does not break even under a heavy load but yields when the load becomes too high. In accordance with one advantageous additional feature of the invention, locking is arranged mainly between the locking tip of the retainer in the pull tab and the bottom cover of the slider outside or from outside the rear of the cover plate (upper cover) (not through the cover plate, as locking is generally accomplished).

The slider for a zip fastener in accordance with the invention is suitable for use both in zip fasteners sliders provided with a retainer and in those without a retainer.

The zip fastener slider in accordance with the invention is particularly reliable in operation because the pull tab comes off and can generally be detached only when the tooth part of the zip fastener itself has not been threaded inside the slider. In accordance with some advantageous embodiments of the invention, by bending the tab holder or by shaping the tab holder/rail, it is also possible to ensure that the pull tab will not come off. A corresponding effect can be achieved by shaping the pull tab or the body part or by arranging the shapes of the body part and the tab holder/rail part to fit together in a desired manner.

In one advantageous embodiment of the invention, further by using a small spring as a member closing the threading gap, a zip fastener slider can be provided into which a pull tab can be passed, for instance, afterwards. A corresponding effect is also achieved by arranging a small spring or a flexible point on the side of the pull tab.

In all of these advantageous embodiments of the invention, the arrangement is simple and the locking itself is located outside the top part, i.e. the top plate, of the slider body. By this means it is possible to avoid the difficulties and limitations caused in the locking which takes place through the top plate.

In accordance with an advantageous feature of the invention, a locking tip can be arranged inside the top plate of the slider of the zip fastener, but in this arrangement locking takes place from outside the rear of the top plate and not through an opening in the top plate.

The invention can also be applied to many other needs, for example, a slider in which a rail part is used instead of a tab holder part can easily be made two-sided, in which case it can be used in reversible clothes and in other similar products.

The slider for a zip fastener in accordance with the invention is simpler in construction than prior art sliders, so that the manufacturing costs of the zip fastener slider are lower than those of prior art zip fastener sliders.

BRIEF DESCRIPTION OF THE DRAWINGS

In the following, the invention will be described in detail with reference to some exemplifying embodiments of the invention shown in the figures of the appended drawing, to the details of which the invention is, however, not by any means meant to be narrowly confined.

FIGS. 10A and 10B schematically show an embodiment of the invention for a two-side zip fastener slider which uses a tab holder part comprising a rail portion and a loop part of the tab holder shaped to be clamp-like.

FIGS. 12A–12F schematically show an embodiment of the zip fastener slider in accordance with the invention in which a tab holder part comprising a rail portion and a loop part of the tab holder shaped to be clamp-like are used.

DETAILED DESCRIPTION OF THE INVENTION

Figure 1A:
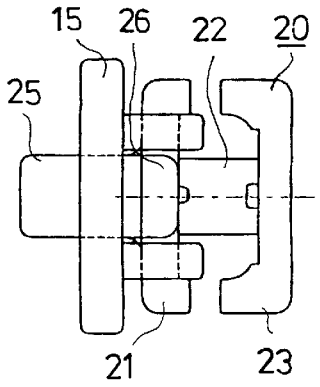
FIGS. 1A–1C show one embodiment of the zip fastener slider in accordance with the invention.
Figure 1B:
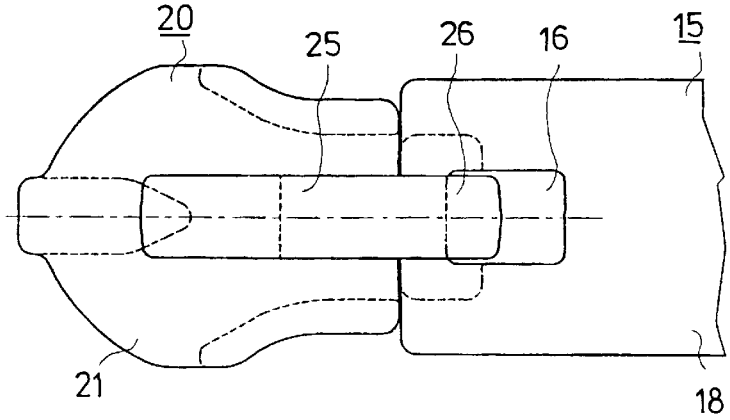
Figure 1C:
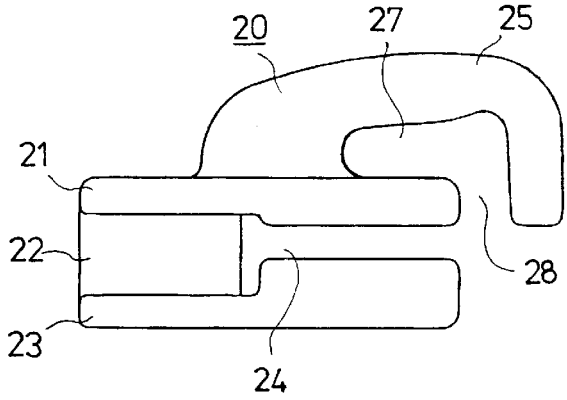
Figure 2:
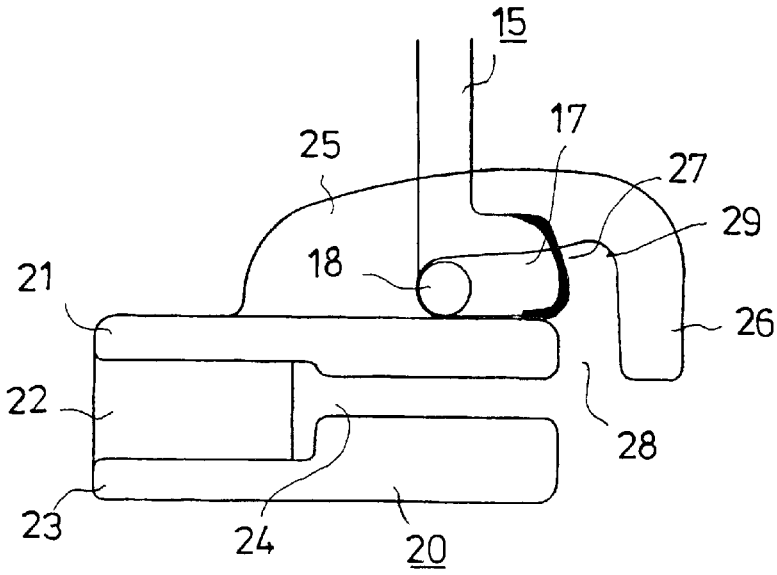
FIG. 2 shows the slider body of the zip fastener shown in FIG. 1C provided with a pull tab, the pull tab being open.

In the different exemplifying embodiments of the invention illustrated in the figures, the same reference signs have been used to designate the parts of the zip fastener slider which correspond to one another.

The slider for a zip fastener shown in the figures comprises a slider body 20 and a pull tab 15. The slider body 20 comprises a top plate i.e. an upper cover 21 and a bottom plate i.e. a lower cover 23 as well as a wedge-shaped part 22 connecting these (the so-called slider heart), which slides against the edges of the tooth rows of the zip fastener 10 when the zip fastener 10 is opened and closed, in which connection the top plate 21 is on one side of the tooth rows and the bottom plate 23 is on the other side. A throat 24 of the zip fastener slider is thus formed between the top plate 21 and the bottom plate 23. The slider body 20 also comprises a tab holder 25, which defines with the top plate 21 a space 27 for fastening of the pull tab 15. The space 27 defined below the tab holder part 25 for fastening of the pull tab can also be defined by two opposite tab holder parts 25. Between the end part or a tail 26 of the tab holder 25 on the slider body 20 and the tail or the rear part of the slider body 20 outside the slider throat 24 there is a threading gap 28 for the pull tab 15. The pull tab 15 comprises a plate-shaped pull part 18 and a loop 16 made into the end on the side of the slider body, which loop is threaded around the tab holder 25 and, in zip fastener sliders provided with a retainer, the pull tab 15 comprises a retainer head 17. The tab holder 25 of the slider body 20 can also be formed such that the portion remaining between an enlarged tab holder part 25 and the top plate 21 is formed into a rail part 32, which rail part 32 is substantially narrower than the enlarged tab holder part 25. Between the end part or the tail 26 of the tab holder 25 on the slider body 20 and the tail or the rear part of the slider body 20 outside the slider throat 24 there is a threading point 33 for the pull tab. In that connection, the pull tab 15 comprises a pull part 18 and a loop-like clamp part 34 made to the end on the side of the slider body 20, which clamp part 34 thus does not form a perfect loop but between the clamp parts there remains a gap 35, which is passed through the threading point 33 around the enlarged tab holder part 25, in which connection the clamps 34 are positioned on both sides of the rail part 32. In the parts provided with a retainer, the pull tab 15 further comprises the retainer head 17.

The pull tab 15 is fastened to the slider body 20 such that the loop 16 of the pull tab 15 is threaded below the tab holder 25 of the slider body 20 through the threading gap 28, which is outside the slider body 20 at the rear of the slider body 20 with respect to the running direction of the slider closing the zip fastener, i.e. between the rear of the slider and the tail part 26 of the tab holder 25, and the loop 16 is positioned around the tab holder 25. The pull tab 15 remains in place when the slider 20 of the zip fastener has been threaded into its position. For threading the pull tab 15 below the tab holder 25 of the slider body 20, the tail 28 of the tab holder 25 is shaped and dimensioned such that it extends outside the throat 24 of the slider 20, whereby the space 28 is formed for threading the pull tab 15. The tab holder 25 of the slider body is thus shaped so that the tail part 26 of the tab holder 25 extends over the tail or the rear part of the top plate 21 of the slider body 20. In that connection, the threading gap 28 provided for the threading of the pull tab 15 is located between the end 26 of the tab holder part 25 and the end of the top plate 21 of the slider body 20. The pull tab 15, which has been formed to be clamp-like, is fastened to the slider body 20 such that the gap 35 remaining between the clamps 34 of the pull tab 15 is threaded onto the rail part 32 of the slider body and the loop-like portion 16 passes around the enlarged tab holder part 25 and the threading takes place through the threading point 33, which is outside the slider body 20 between the end on the side of the pull tab 15 of the slider body 20 and the tail part 26 of the tab holder 25. The pull tab 15 remains in place when the slider 20 of the zip fastener has been threaded into its position.

In the figures, a snap slot made into the lower surface of the tab holder part 25 is designated by the reference numeral 29. A threading part 18 of the pull tab 15 is positioned in the snap slot or another equivalent recess 29, which threading part is provided with slots or grooves 19A, 19B to facilitate the threading through the threading gap 28, which slots or grooves make the circular form lighter, in which connection the threading is easy to accomplish and the only threading direction is easy to determine. The teeth of the zip fastener 10 are designated by the reference numeral 11.

Figure 3:
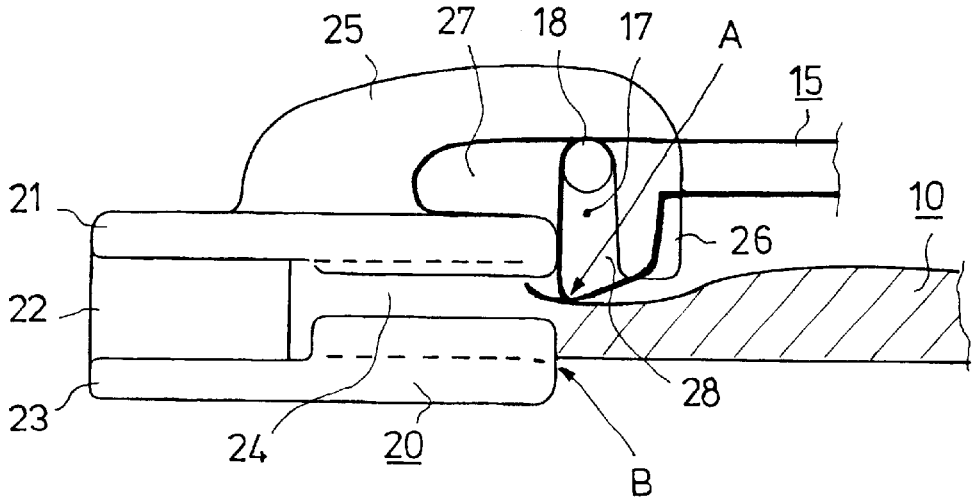
FIG. 3 shows the slider body of the zip fastener shown in FIG. 1C provided with a pull tab, the pull tab being closed.

FIG. 3 shows locking points A and B of a zip fastener slider with a retainer when the pull tab has been turned into a locking position and the zip fastener 10 is in place in the slider of the zip fastener. By displacing the locking points A, B, the locking force of the slider of the zip fastener, the snapping of the pull tab into a locking position and away from the locking position, can be displaced and, at the same time, it is possible to utilize the stiffness and bending of the zip fastener 10 outside the throat 24 of the slider 20, which means that the locking of the slider is easy to adjust for different purposes and chain types by shaping the retainer head 17 of the pull tab 15 as needed in each particular case.

Figure 4:
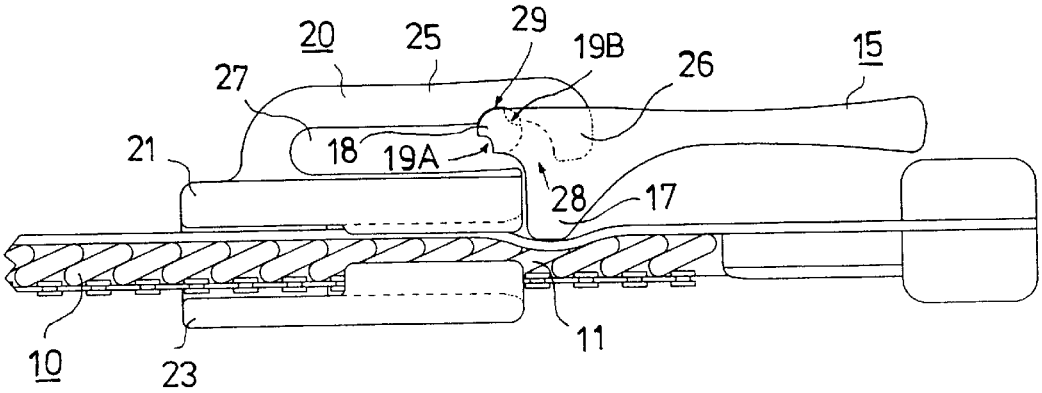
FIG. 4 schematically shows the principle of displacement of the locking point used in one embodiment of the zip fastener slider in accordance with the invention.

The schematic exemplifying embodiment shown in FIG. 4 illustrates the possibility of displacing the locking point applied in connection with the zip fastener in accordance with the invention. By displacing the locking point, the fully locking slider 20 of the zip fastener can be made into an arrangement in which locking holds only up to a certain limit. In that case, the zip fastener 10 does not break even under a heavy load but yields when the load becomes too high. As shown in the example of the figure, the locking point has been displaced by displacing the locking point of the pull tab 15, i.e. the snap slot 29 on the lower surface of the tab holder part 25 has been displaced in the embodiment shown in the figure in a direction away from the end of the tab holder part 25 on the side of the tail part 26 towards the front part of the tab holder part 25.

Figure 5:
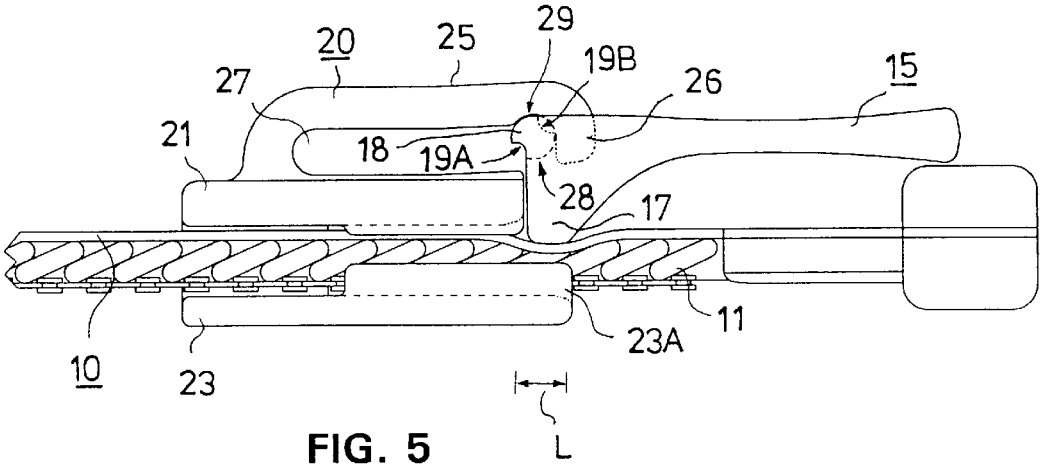
FIG. 5 schematically shows one embodiment of the invention in which locking is arranged between the locking tip of the pull tab and the bottom cover of the slider.

FIG. 5 is a schematic view of an embodiment of the invention in which locking is arranged mainly between the locking tip 17 of the pull tab and the lower cover 23 of the slider 20. This is accomplished by lengthening the lower cover 23 with a part 23A, so that it extends a distance L over the length of the upper cover 21. In that case, the locking is formed between the retainer part 17 of the pull tab 15 and the upper surface of the extension part 23 of the lower cover. In this manner, the slider 20 of the zip fastener is locked in place in the zip fastener 10.

Figure 6:
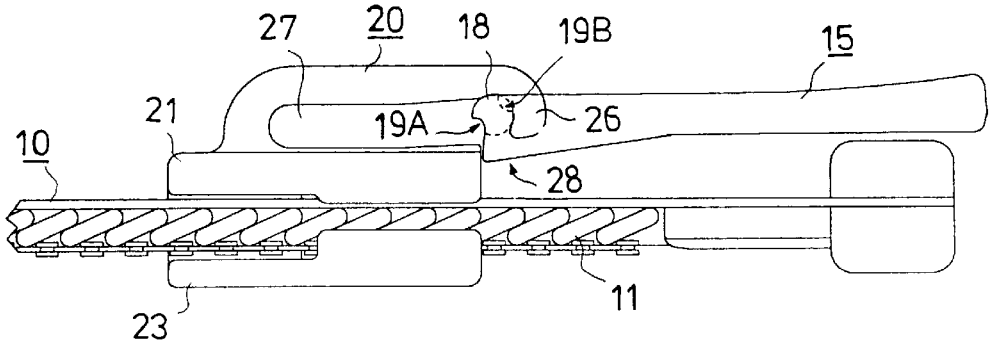
FIG. 6 schematically shows an embodiment of the invention for a zip fastener slider without a retainer.

FIG. 6 is a schematic view of an embodiment of the invention for a zip fastener slider without a retainer, i.e. the pull tab 15 of the zip fastener does not comprise any retainer part. In that case, the end of the pull tab 15 of the zip fastener on the side of the slider 20 is shaped such that no retainer part is formed in it, in which connection, when the pull tab is in a position parallel to the zip fastener 10, no part of it is pressed against the zip fastener 10, with the result that no locking takes place.

Figure 7A:
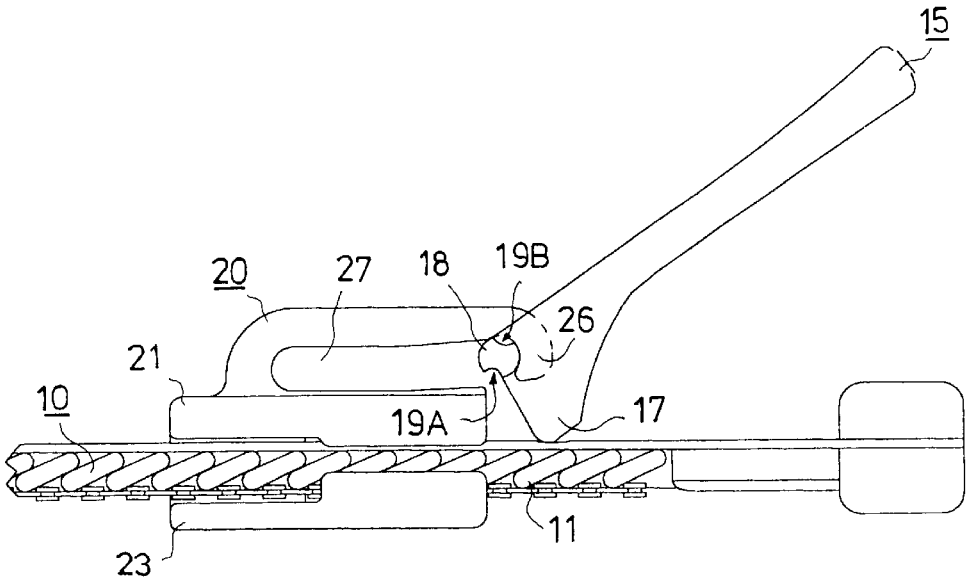
FIGS. 7A and 7B show one embodiment of the invention for a slider structure of a zip fastener which is provided with a retainer and in which cushion-like locking is applied.

The embodiment shown in FIG. 7A illustrates an embodiment of the zip fastener slider with a retainer in accordance with the invention, cushion-like locking being used in this embodiment. In this embodiment, the part of the retainer part 17 of the pull tab 15 to be placed against the zip fastener 10 is shaped to be substantially plane, so that in the locking position (see FIG. 7B) it produces a locking force against several teeth 11 of the zip fastener 10. This arrangement does not require a locking slot and it is intended to operate, among other things, when locking the so-called coil zip fastener from the side of the tape, as shown in the figure.

Figure 7B:
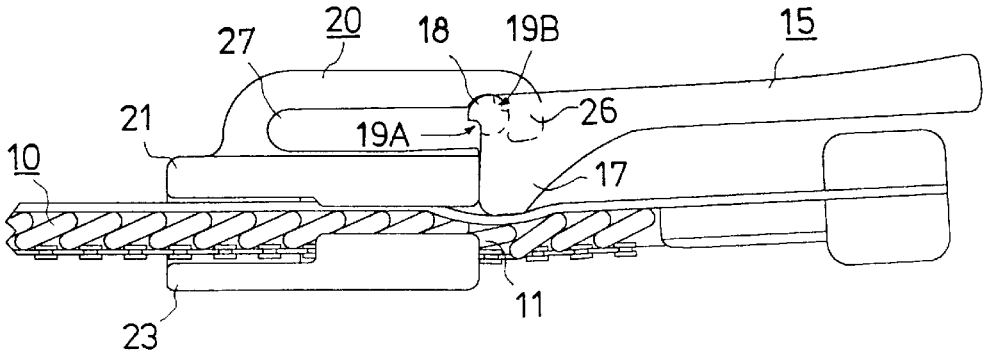

FIG. 7B shows a schematic embodiment of the invention which uses the so-called cushion locking. Here, the snapping of the pull tab 15 into a locking position and away from the locking position is also adjusted by shaping the lower surface of the tab holder part 26, in which there is a snap slot 29 in the lower part of the tab holder 25. In FIG. 7B, the pull tab 15 fastened to the tab holder part 25 is in the locking position and placed in the snap slot 29 made to the lower surface of the tab holder part 25.

Figure 8:
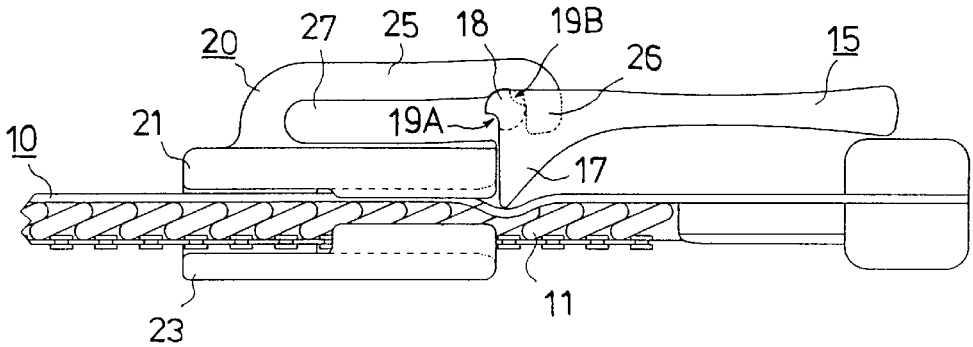
FIG. 8 schematically shows an embodiment of the invention for a zip fastener slider which is provided with a retainer and in which pin-like locking is used.

FIG. 8 shows a schematic embodiment of an embodiment of the zip fastener slider with a retainer in accordance with the invention, pin-like locking being used in this embodiment. In this embodiment, the retainer part 17 of the pull tab 15 is formed so that it is pin-shaped, in which connection its tip is substantially sharp producing a sharper locking effect against teeth 11 of the zip fastener 10 or against some other part of the zip fastener.

Figure 9A:
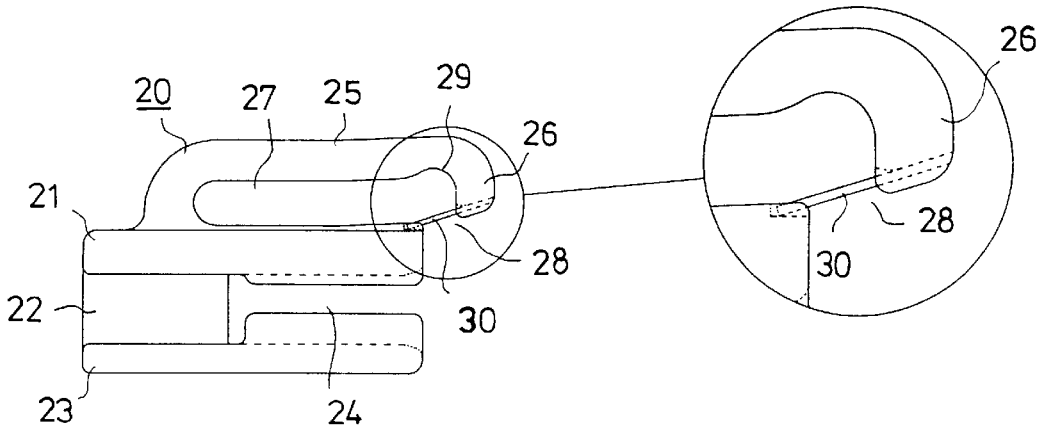
FIGS. 9A–9F schematically show an embodiment of the invention in which the closing of a threading opening for a pull tab of a zip fastener is accomplished by means of a spring, i.e. using the carabine hook effect.

FIG. 9A shows one embodiment of the zip fastener in accordance with the invention in which a small spring 30 is used as a member closing the threading gap 28. The spring extends from the upper surface of the upper cover 21 of the zip fastener slider 20 to the end of the tail part 26 of the tab holder part 25, thus forming a closing member for the threading gap 28. FIG. 9A also shows a partial enlargement from the area of the threading gap 28. In this embodiment, the closing of the threading gap is accomplished using the so-called carabine hook effect.

Figure 9B:
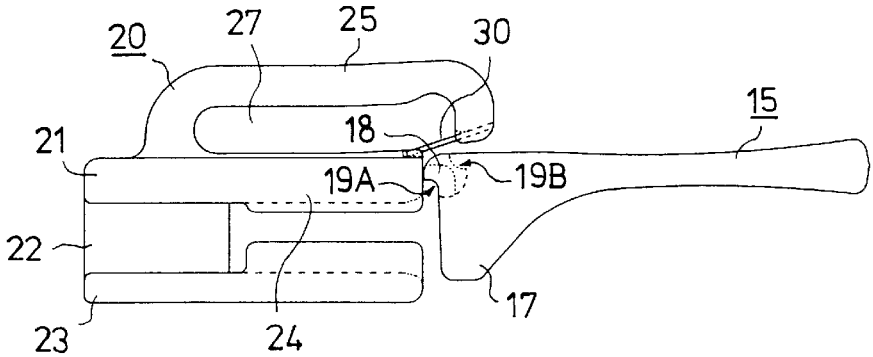

FIG. 9B shows a situation in which the pull tab 15 of the zip fastener slider 20 is passed into the zip fastener slider 20 shown in FIG. 9A.

Figure 9C:
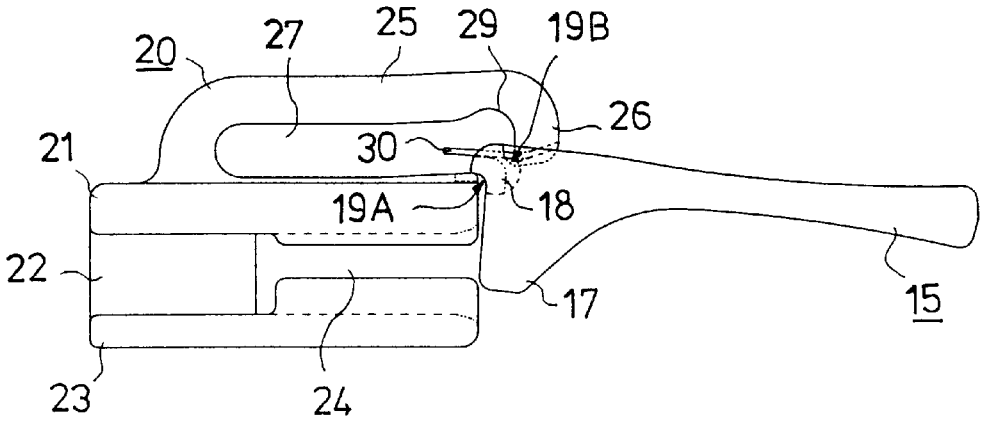

In the situation shown in FIG. 9C, the pull tab 15 is threaded in through the threading gap 28, in which connection the closing member 30 opens from the end on the side of the cover 21 of the zip fastener slider 20, so that the pull tab 15 can be threaded into its position through the threading gap 28 between the tail part of the tab holder part 25 and the upper cover 21 of the slider 20 on the zip fastener. The spring or a flexible point can also be located on the side of the pull tab.

Figure 9D:
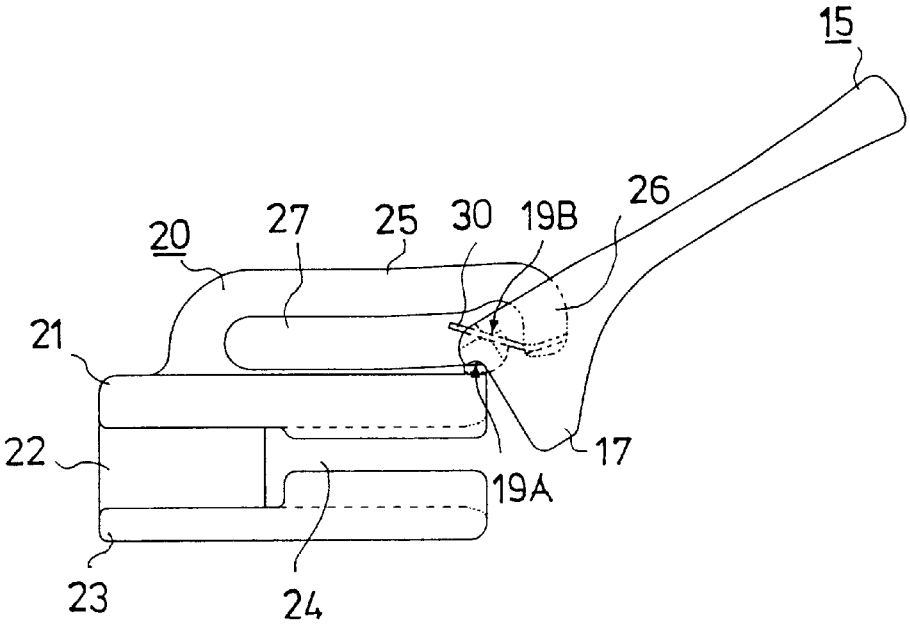

Grooves 19A and 19B have been formed in the threading part 18 of the pull tab 15 of the zip fastener to facilitate threading and to ensure the only threading direction, as shown in FIG. 9D.

Figure 9E:
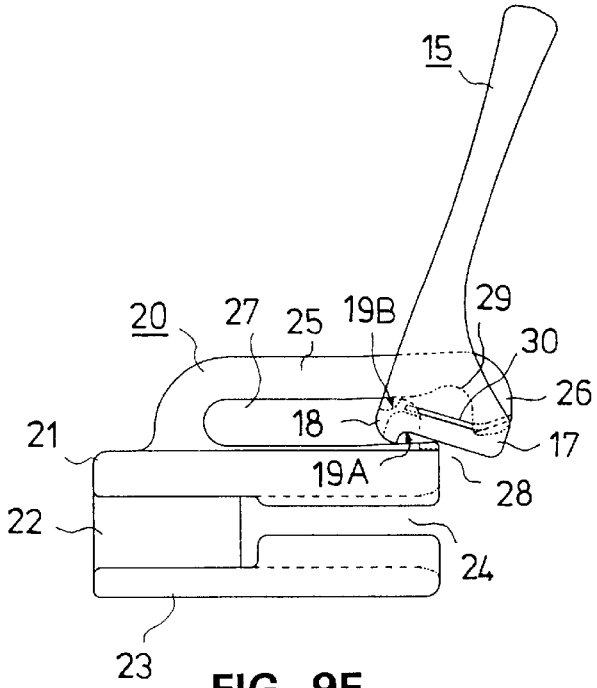

In the situation shown in FIG. 9E, the pull tab 15 of the slider 20 of the zip fastener is turned into its position when the closing member 30 is still open.

Figure 9F:
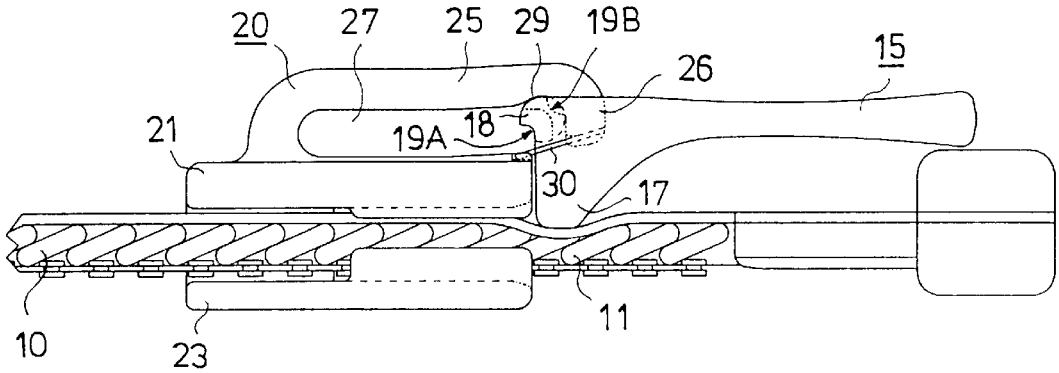

In the situation shown in FIG. 9F, the pull tab 15 is in place in the slider 20 of the zip fastener in a locking position, in which connection the closing member, for example, the spring 30 is in place closing the threading gap 28 and the retainer part 17 of the pull tab 15 is pressed against teeth of the zip fastener 10 producing a locking effect.

Figure 10A:
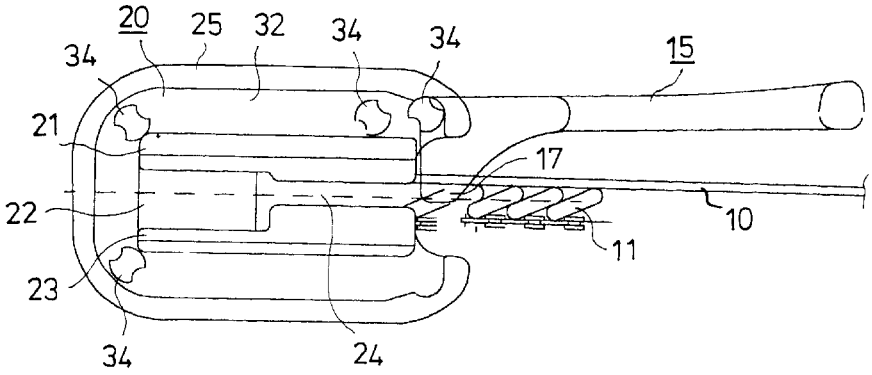
Figure 10B:
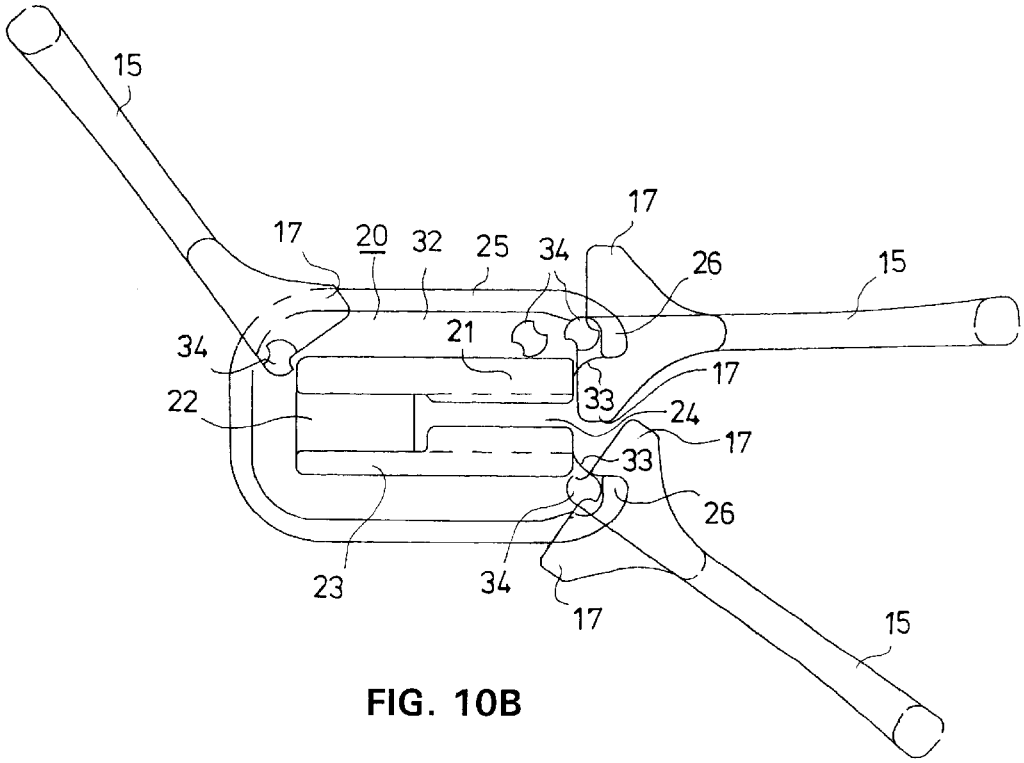

FIGS. 10A and 10B show embodiments of the zip fastener slider 20 in accordance with the invention for use in a two-side zip fastener as a slider on the zip fastener. In constructions of principle, this kind of zip fastener slider 20 corresponds to the zip fastener sliders 20 illustrated in the preceding figures except that here the tab holder part 25 extends around the slider 20 of the zip fastener except for the part on the rear of it with respect to the running direction of the slider closing the zip fastener, where it extends only in the area of the tail parts 26, and a narrower rail part 32 is formed on the tab holder part 25, the rail part joining to the top plate 21 of the slider body and forming a threading point 33 for threading the pull tab 15 into its position. As shown in FIG. 10B, in this kind of slider 20 it is possible to use a slider 15 that comprises clamp parts 34 on both sides, a gap 35 remaining between the clamp parts for threading to provide fastening on both sides of the zip fastener 10.

Figure 11A:
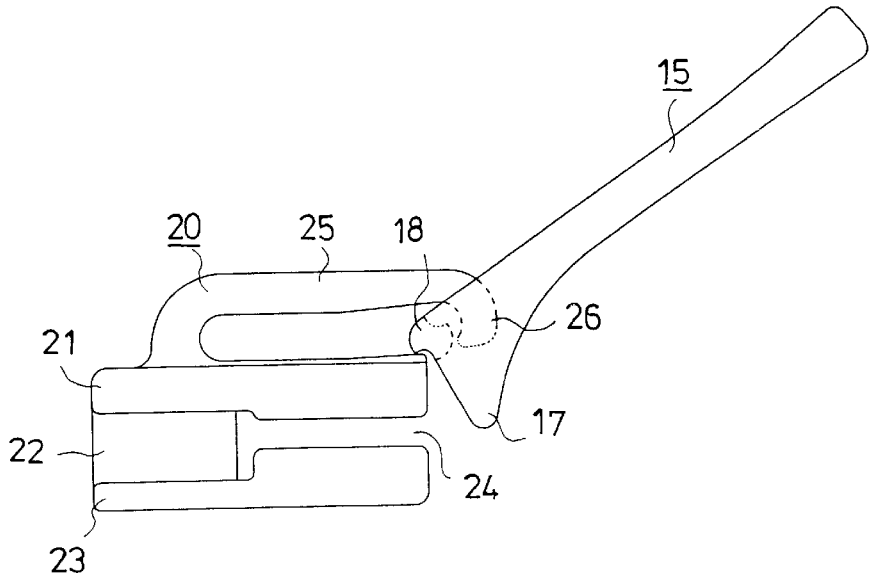
FIGS. 11A–11G schematically show a pull tab of a zip fastener in a zip fastener slider in accordance with the invention in different positions when the zip fastener is in place and away from its place in the slider body of the zip fastener.
Figure 11B:
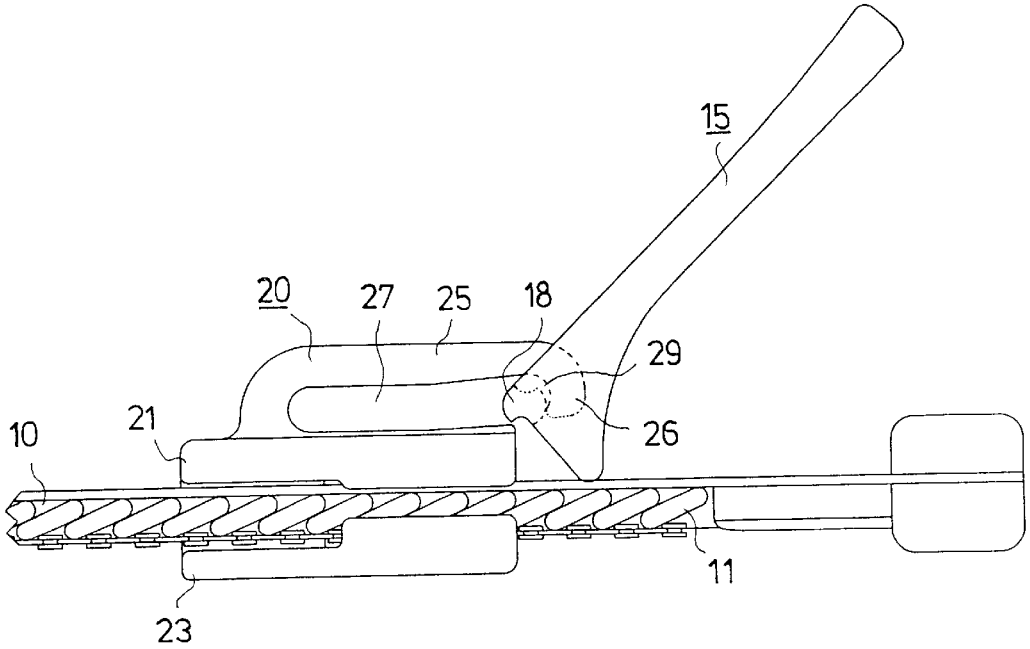
Figure 11C:
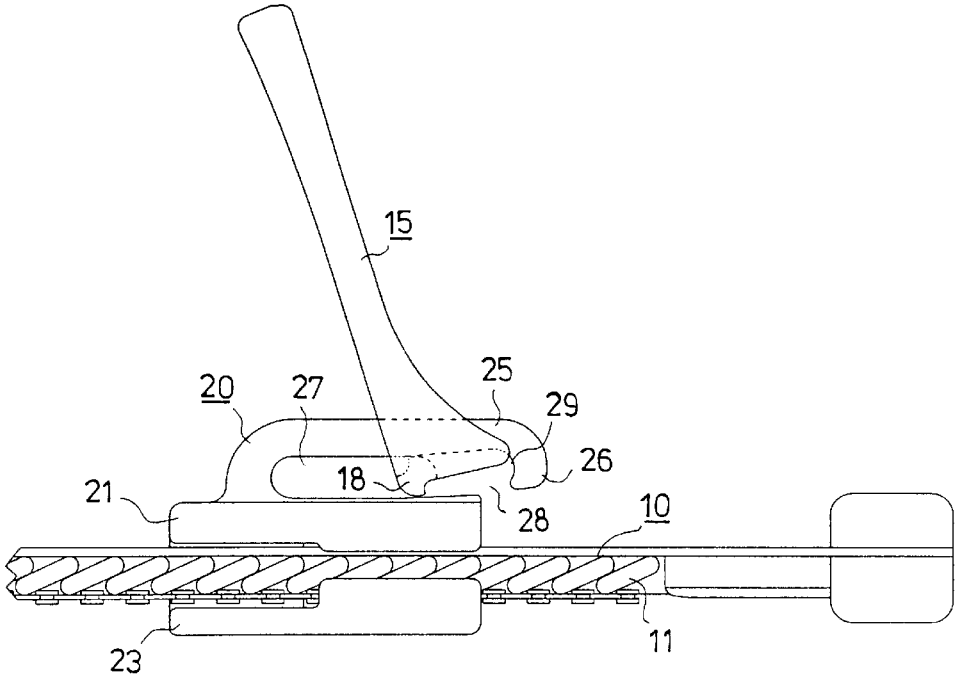
Figure 11D:
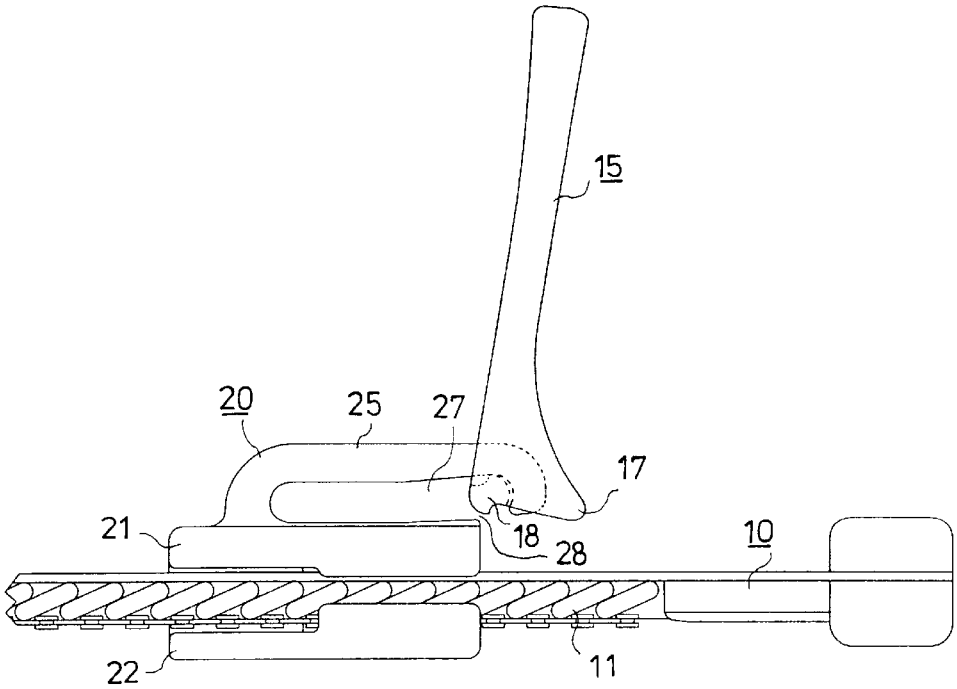
Figure 11E:
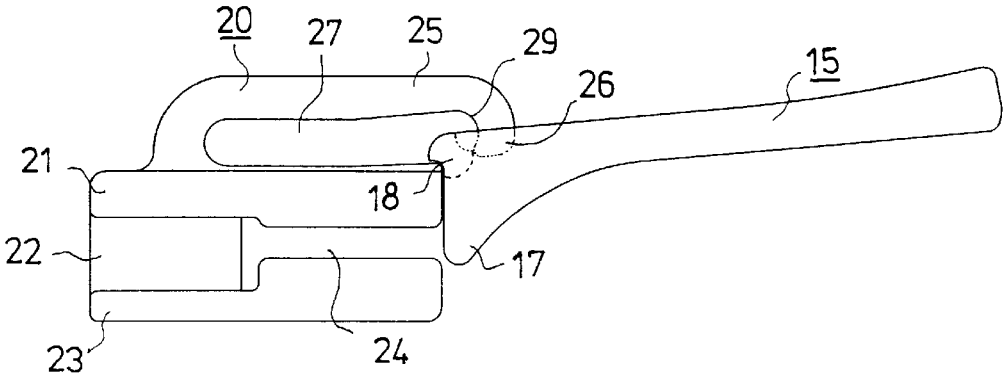
Figure 11F:
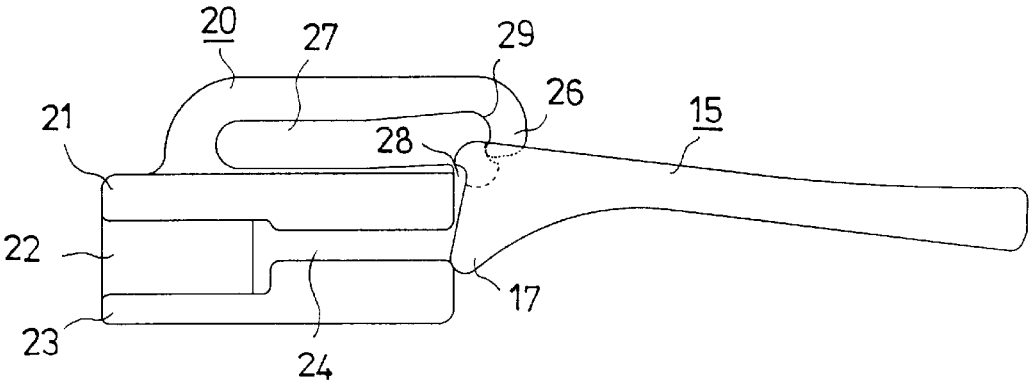
Figure 11G:
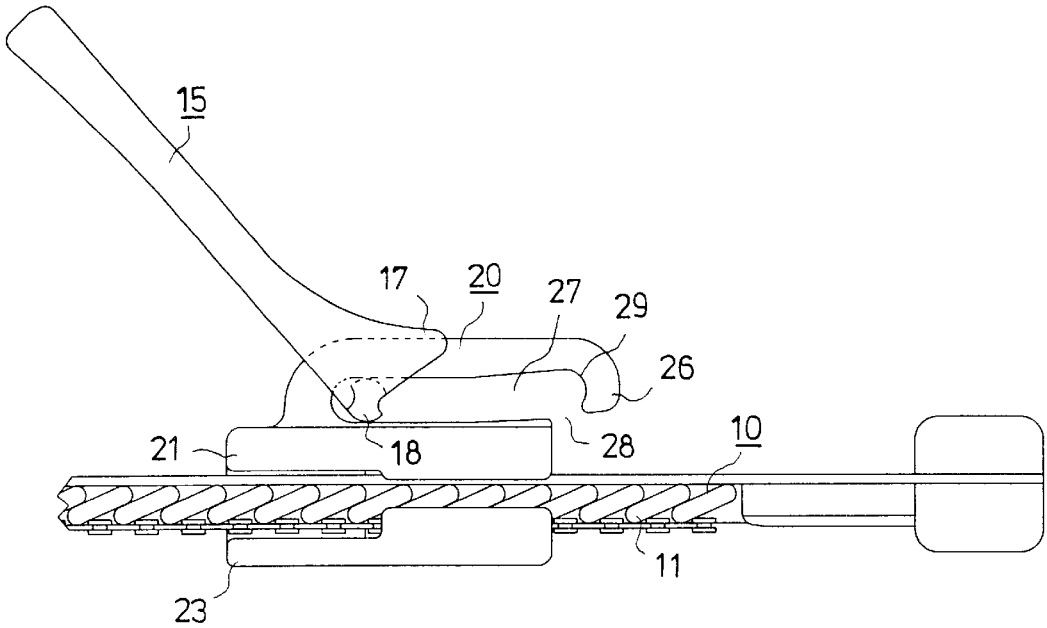

FIGS. 11A–11G show a slider 20 of a zip fastener and its pull tab 15 in different positions of the pull tab in zip fastener sliders. In FIG. 11A, the pull tab 15 is being threaded into the slider 20 of the zip fastener. FIG. 11B shows the pull tab 15 in a position corresponding to that of FIG. 11A, but here the zip fastener 10 is in place, in which connection it is seen that the pull tab 15 remains in place when the zip fastener 10 is in the slider 20 of the zip fastener. In FIG. 11C, the slider 20 of the zip fastener is placed in the zip fastener 10 and the pull tab part 15 is in a pulling position. FIG. 11D shows another pull position of the pull tab 15. FIG. 11E shows a situation in which the pull tab 15 of the slider 20 on the zip fastener 10 is threaded away from its position and the same is shown further in the next stage in FIG. 11F. FIG. 11G shows the zip fastener slider 20 with the pull tab 15 placed in an extreme pull position.

Figure 12A:
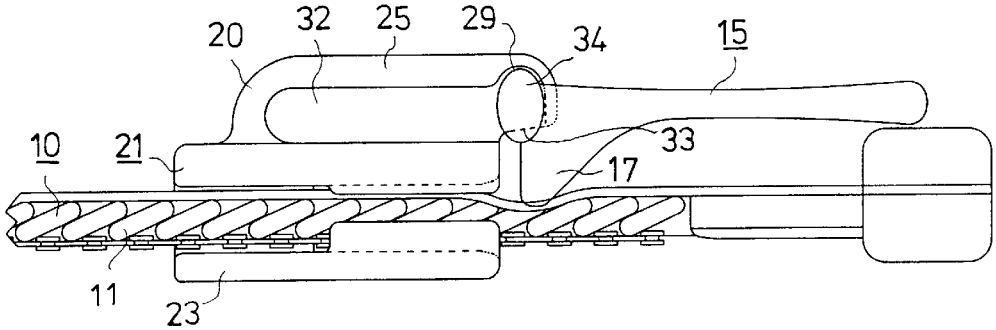
Figure 12E:
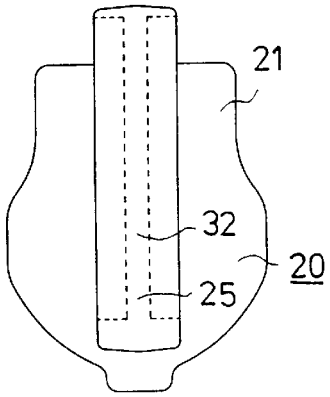
Figure 12F:
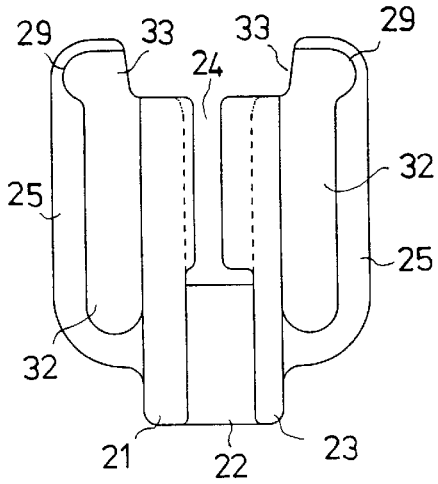

FIGS. 12A–12F show a zip fastener slider 20 in which the tab holder part 25 comprises a rail 32 attached to the upper surface of the top plate 21 of the slider body 20 over its entire length except for the area of the threading points. The pull tab 15 comprises clamp parts 34 threaded on both sides of the rail 32 through a threading point 33. In FIGS. 12E–12F there is a two-side body 20.

Figure 13A:
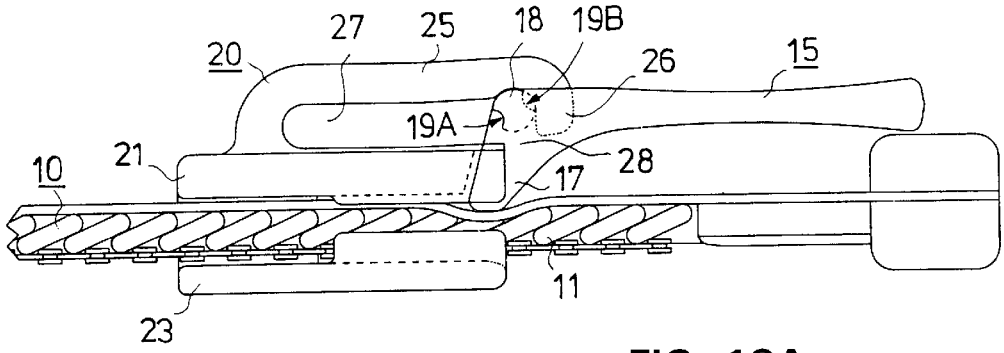
FIGS. 13A–13D schematically show an embodiment of the zip fastener slider in accordance with the invention in which a locking tip is arranged inside the top plate of the zip fastener slider.
Figure 13B:
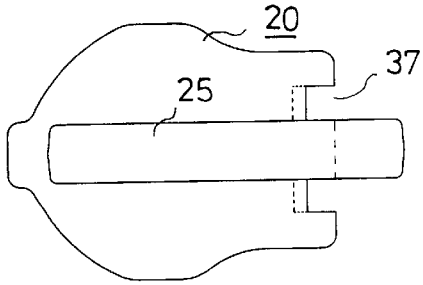
Figure 13C:
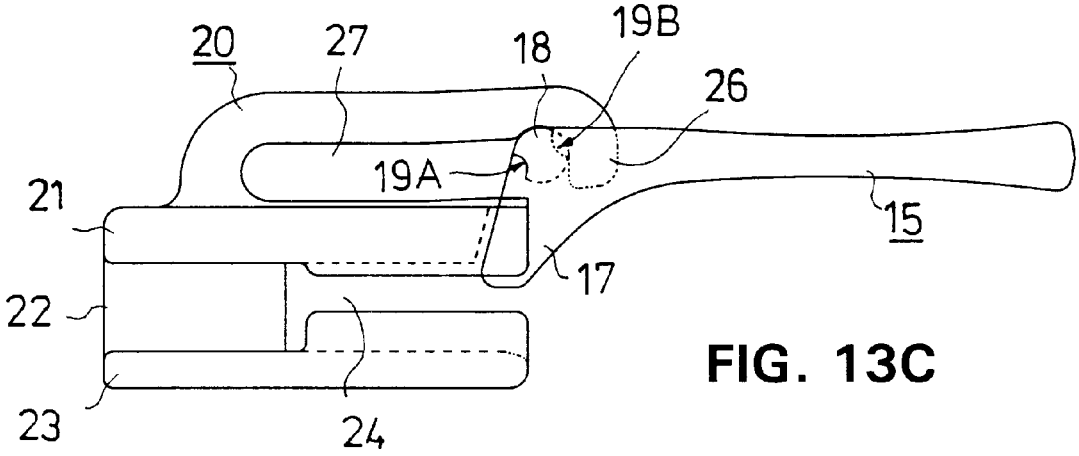
Figure 13D:
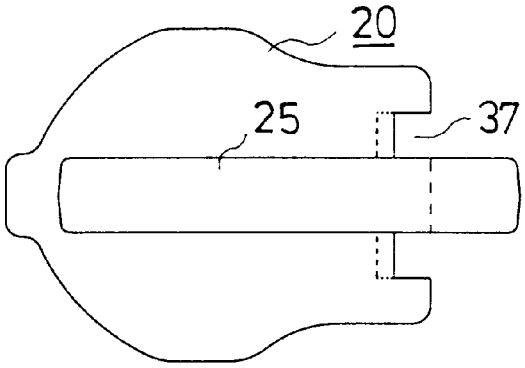
Figure 13E:
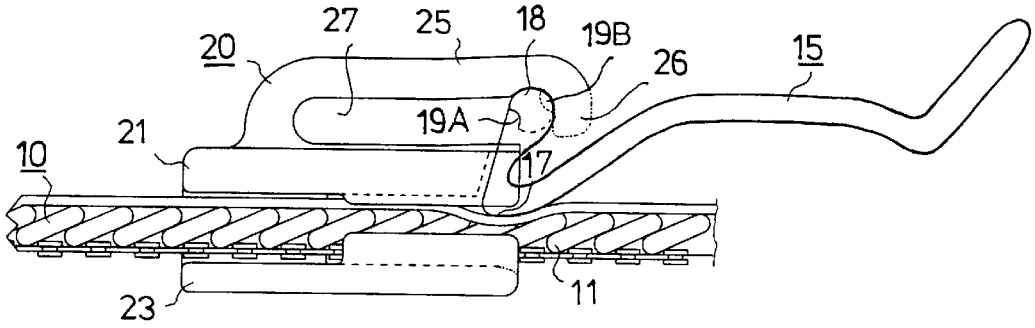
FIGS. 13E–13F schematically show an embodiment of the zip fastener slider in accordance with the invention in which the locking tip is shaped to be flexible.
Figure 13F:
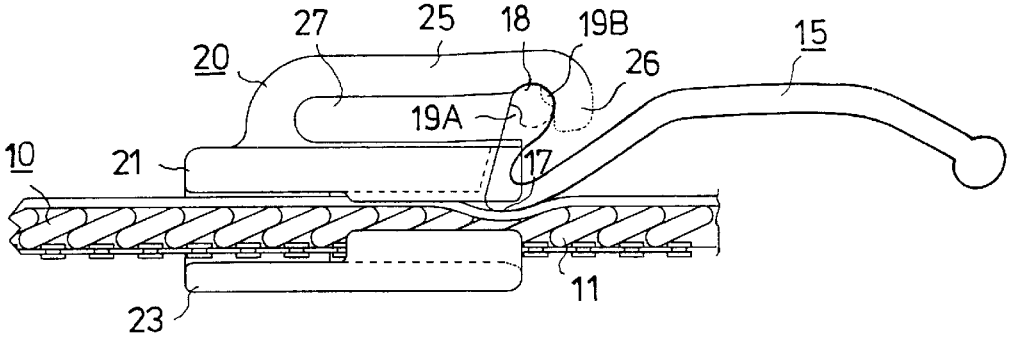

FIGS. 13A–13D schematically show some advantageous embodiments in which the locking tip of the pull tab 15, i.e. the retainer head 17, is placed inside the body of the slider 20 of the zip fastener 10, in which connection an indentation 37 is formed in the rear part of the top plate for the retainer head. In the embodiments of the invention shown in FIGS. 13E–13F, the retainer head 17 is shaped to be flexible. The retainer head 17 may also be of a hard or flexible material in different embodiments of the invention.

When the pressing stage of the retainer head takes place outside the throat of the slider, a smaller or greater spring effect is produced in which the tab holder can behave flexibly, in which the retainer head can behave flexibly and in which the zip fastener 10 behaves flexibly, which flexible behaviours and the dimensioning of lever arms serve to provide a locking head that is positioned beyond the dead centre. This kind of locking can be absolutely tight, while, for example, the prior art locking accomplished by a spring is hardly ever so tight; or it can be even very light locking according to the need of dimensioning in each particular case.

What is claimed is:

1. A slider for a zip fastener comprising:

a pull tab having a loop; and a slider body comprising a top plate, a bottom plate spaced from said top plate to define a throat therebetween, a wedge-shaped part connecting said top plate and said bottom plate, and a tab holder for fastening said loop of said pull tab, said tab holder including a tail part extending rearwardly beyond a rear end of said top plate and spaced from said rear end of said top plate such that a threading gap is formed between said tail part and said rear end of said top plate and thus rearward of said rear end of said top plate of said slider body, said pull tab being threadable into connection with said tab holder through said threading gap, and said tab holder having a shape which prevents said pull tab from coming off said slider body after said pull tab has been threaded into connection with said tab holder such that locking of said slider body is placed, as viewed in a horizontal plane, outside a rear of said top plate or to operate, as viewed in a horizontal plane, from outside the rear of said top plate.

2. A slider for a zip fastener as claimed in claim 1, wherein the shape of said tab holder is such that said threading gap remains open after said pull tab has been threaded into connection with said tab holder and when said pull tab has been threaded into said slider body, said pull tab is prevented from coming off.

3. A slider for a zip fastener as claimed in claim 1, further comprising a closing member for closing said threading gap, said closing member being attached to said tail part of said tab holder such that it is openable to ensure that said pull tab does not come off.

4. A slider for a zip fastener as claimed in claim 1, wherein said tab holder comprises a rail part attached to said top plate, and said pull tab comprises clamp parts placed on both sides of said rail part.

5. A slider for a zip fastener as claimed in claim 1, wherein said pull tab comprises a retainer head arranged to lock said slider body in place when the zip fastener has been placed in said slider body.

6. A slider for a zip fastener as claimed in claim 5, wherein said retainer head of said pull tab is arranged to press against teeth of the zip fastener to produce a locking effect.

7. A slider for a zip fastener as claimed in claim 5, wherein locking points formed by said retainer head are displaceable to adjust a locking force provided by said retainer head.

8. A slider for a zip fastener as claimed in claim 5, wherein said retainer head has a variable shape to enable adjustment of a locking force provided thereby.

9. A slider for a zip fastener as claimed in claim 1, wherein said tail part of said tab holder is arranged to extend proximate the zip fastener.

10. A slider for a zip fastener as claimed in claim 9, wherein said threading gap is from 0.5 mm to 3 mm.

11. A slider for a zip fastener as claimed in claim 1, wherein said tab holder part includes a snap slot formed in a lower surface to ensure permanence of a desired locking position.

12. A slider for a zip fastener as claimed in claim 5, wherein said top plate includes an indentation for said retainer head, said retainer head being placed from behind inside said slider body.

13. A slider for a zip fastener as claimed in claim 1, wherein said slider body comprises members for producing a spring effect to provide compression locking between a retainer head of said slider and the zip fastener.

14. A slider for a zip fastener as claimed in claim 13, wherein said tab holder part includes a snap slot formed in a lower surface to produce the spring effect.

15. A slider for a zip fastener as claimed in claim 13, wherein said retainer head is flexible to produce the spring effect.

16. A slider for a zip fastener as claimed in claim 15, wherein said retainer head is shaped to be flexible.

17. A slider for a zip fastener as claimed in claim 15, wherein said retainer head is made of a flexible material.

18. A slider for a zip fastener as claimed in claim 13, wherein said tab holder part is flexible to produce the spring effect.

19. A slider for a zip fastener as claimed in claim 13, wherein a lower cover of said slider body includes a hole, the zip fastener being flexible inside the throat of said slider body.

20. A slider for a zip fastener as claimed in claim 1, wherein a space formed below said tab holder part is defined by two opposite tab holder parts.

* * * * *